US012012854B2

(12) United States Patent
Alosaimi

(10) Patent No.: US 12,012,854 B2
(45) Date of Patent: Jun. 18, 2024

(54) SIDETRACK CASING ASSEMBLY FOR DRILLING SIDETRACK WELLBORES

(71) Applicant: SAUDI ARABIAN OIL COMPANY, Dhahran (SA)

(72) Inventor: Sultan Alosaimi, Makkah (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/055,942

(22) Filed: Nov. 16, 2022

(65) Prior Publication Data

US 2024/0159110 A1 May 16, 2024

(51) Int. Cl.
*E21B 7/06* (2006.01)

(52) U.S. Cl.
CPC ..... *E21B 7/061* (2013.01); *E21B 7/067* (2013.01)

(58) Field of Classification Search
None
See application file for complete search history.

(56) References Cited

U.S. PATENT DOCUMENTS 5,462,120 A * 10/1995 Gondouin ..... E21B 7/061 166/380
6,012,526 A * 1/2000 Jennings ..... E21B 41/0035 166/55.7
6,041,855 A * 3/2000 Nistor ..... E21B 29/06 166/242.6
6,374,924 B2 * 4/2002 Hanton ..... E21B 17/00 175/9
7,104,332 B2 * 9/2006 Murray ..... E21B 41/0042 166/380
7,455,110 B2 * 11/2008 Lynde ..... E21B 43/117 166/117.6
7,669,664 B2 * 3/2010 McGarian ..... E21B 41/0042 166/382
10,053,940 B2 * 8/2018 Coats ..... E21B 7/06
10,605,013 B2 * 3/2020 Gosney ..... E21B 41/0035
2002/0003040 A1 * 1/2002 Brunet ..... E21B 17/10 166/380
2011/0226467 A1 * 9/2011 Hepburn ..... E21B 41/0035 166/88.1

OTHER PUBLICATIONS

Grigor, C., and R. A. Seale. "Development of a Single-Trip Coiled Tubing Sidetracking System." Paper presented at the SPE/CIM International Conference on Horizontal Well Technology, Calgary, Alberta, Canada, Nov. 2000.

(Continued)

*Primary Examiner* — D. Andrews
(74) *Attorney, Agent, or Firm* — Vorys, Sater, Seymour and Pease, LLP

(57) ABSTRACT

A well system includes a casing string extendable into a primary wellbore from a surface rig, and a sidetrack casing assembly coupled to the casing string. The sidetrack casing assembly includes a cylindrical housing that defines a window through a sidewall of the housing, and a cover removably coupled to the housing at the window. The cover is transitionable between a closed state, in which the cover is attached to the housing and occludes the window, and an open state, in which the cover is moved to expose the window for drilling a secondary wellbore from the primary wellbore.

12 Claims, 8 Drawing Sheets

(56) References Cited

OTHER PUBLICATIONS

Bruton, G. & Land, J. & Moran, D. & Swadi, Saba & Strachan, R. & Tørge, K.. (2014). Whipstock options for sidetracking. Oilfield Review. 26. 16-25.

Emelander, Tom. "Efficient and Consistent Sidetracking Operations Lower Production Costs While Minimizing Footprint in Shallow Re-Entry Wells." Paper presented at the SPE Western Regional Meeting, Bakersfield, California, USA, Apr. 2022.

PathMaster whipstock system Mill in one trip in short-radius wellbores with high doglegs; retrived from https://www.bakerhughes.com/sites/bakerhughes/files/2020-08/Pathmaster-whipstock-system-spec.pdf on Nov. 15, 2022.

* cited by examiner

SIDETRACK CASING ASSEMBLY FOR DRILLING SIDETRACK WELLBORES

FIELD OF THE DISCLOSURE

The present disclosure relates generally to wellbore drilling and, more particularly, to drilling and creating a sidetrack (lateral) wellbore from a primary wellbore.

BACKGROUND OF THE DISCLOSURE

A sidetrack wellbore is a secondary, deviated wellbore that extends from a main (primary) wellbore. Sidetrack wellbores may be used to extract hydrocarbons from an alternate subterranean zone or formation, or to remedy a problem existing in the main wellbore.

Conventionally, after logging the main wellbore and confirming that a sidetrack wellbore is needed, a wellbore liner or "casing" is typically cemented into place within the main wellbore. A whipstock assembly may then be run into the casing and secured at a location where a sidewall window for the sidetrack wellbore is to be created. The whipstock assembly is used to deflect a mill into the wall of the casing and thereby create the sidewall window. The mill is deployed downhole and eventually reaches the whipstock, which deflects and forces the mill into the wall of the casing, which allows the mill to drill the sidewall window and thereby start the sidetrack wellbore in a desired orientation and location. After opening (forming) the window, the mill is then pulled out of the hole and a drilling bottom-hole-assembly (BHA) is run downhole and forced through the side window with the whipstock.

The above-described process is time-consuming and costly because it requires tripping (going downhole and back out) three times and also requires a clean-out process for the side window. There is, therefore, a need to reduce the time, effort, and cost to create a sidetrack wellbore.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system includes a casing string extendable into a primary wellbore from a surface rig, and a sidetrack casing assembly coupled to the casing string. The sidetrack casing assembly can include a cylindrical housing that defines a window through a sidewall of the housing, and a cover removably coupled to the housing at the window. The cover is transitionable between a closed state, in which the cover is attached to the housing and occludes the window, and an open state, in which the cover is moved to expose the window for drilling a secondary wellbore from the primary wellbore.

According to another embodiment consistent with the present disclosure, a method of creating a secondary wellbore from a primary wellbore includes conveying a casing string into the primary wellbore from a surface rig, wherein a sidetrack casing assembly is coupled to the casing string and includes a cylindrical housing that defines a window through a sidewall of the housing, and a cover removably coupled to the housing at the window. The method may further include anchoring the casing string within the primary wellbore at a predetermined depth and a predetermined angular orientation where the window aligns with a proposed wellbore path for the secondary wellbore, transitioning the cover from a closed state, in which the cover is attached to the housing and occludes the window, to an open state, in which the cover is moved to expose the window, advancing a drilling assembly into the casing and through the window, and drilling the secondary wellbore with the drilling assembly.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
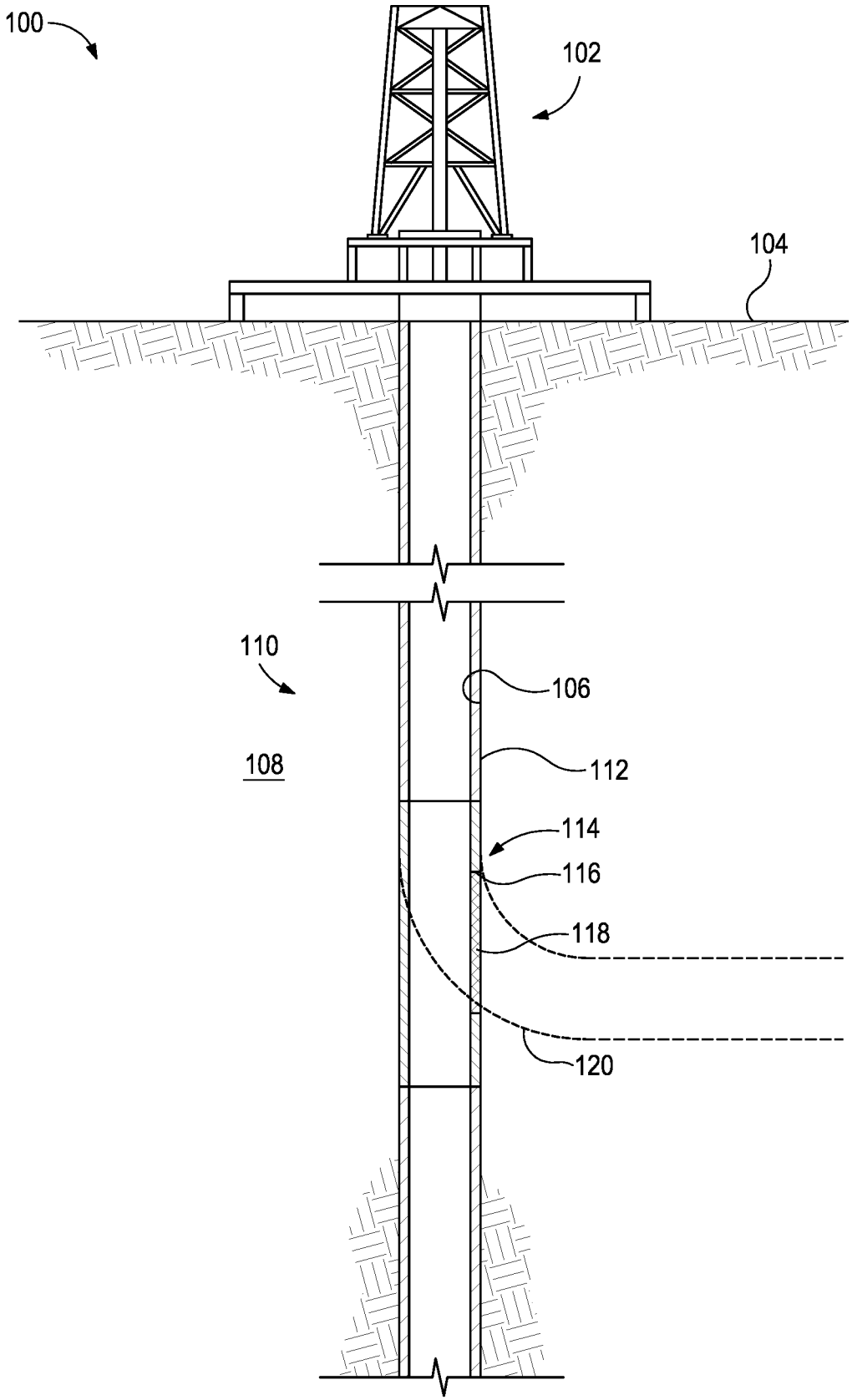
FIG. 1 is a schematic diagram of an example well system that may employ one or more principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to a sidetrack casing assembly attachable to a casing string and operable to help create a sidetrack (secondary) wellbore from a primary wellbore. Embodiments described herein may prove advantageous in saving the time, cost, and effort to create a sidetrack (or lateral) wellbore. The presently disclosed sidetrack casing assembly shortens the time for sidetrack creation by eliminating the requirement to mill a window into the casing. In addition, the sidetrack casing assembly is simpler than conventional sidetrack (lateral) wellbore drilling techniques since there is no requirement for a different drilling BHA and multiple runs to create the sidetrack wellbore.

FIG. 1 is a schematic diagram of an example well system 100 that may employ one or more principles of the present disclosure. As illustrated, the well system 100 includes a service rig 102 positioned on the Earth's surface 104 and extending over and around a main or "primary" wellbore 106 that penetrates a subterranean formation 108. The service rig 102 may be a drilling rig, a completion rig, a workover rig, or the like. In some applications, the service rig 102 may be omitted and replaced with a standard surface wellhead completion or installation, without departing from the scope of the disclosure.

While the well system 100 is depicted as a land-based operation, it will be appreciated that the principles of the present disclosure could equally be applied in any offshore, sea-based, or sub-sea application where the service rig 102 may be a floating platform, a semi-submersible platform, or a sub-surface wellhead installation as generally known in the art. Moreover, use of directional terms herein, such as above, below, upper, lower, upward, downward, uphole, downhole, and the like, are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well. If used herein, the term "proximal" refers to that portion of the component being referred to that is closest to the wellhead, and the term "distal" refers to the portion of the component that is furthest from the wellhead.

The primary wellbore 106 may be drilled into the subterranean formation 108 using any suitable drilling technique and may extend in a substantially vertical direction away from the earth's surface 104 over a vertical wellbore portion 110. The primary wellbore 106 may be completed by introducing a string of casing 112, alternately referred to as "casing" or "casing string," into the wellbore 106. Once properly oriented, all or a portion of the casing string 112 may be cemented into place.

According to embodiments of the present disclosure, the well system 100 may further include a sidetrack casing assembly 114 coupled to or forming part of the casing string 112. The sidetrack casing assembly 114 may be secured between upper and lower portions of the casing string 112, or may alternatively form the distal end of the casing string 112. The sidetrack casing assembly 114 defines a window 116, and a cover 118 is removably coupled to occlude (cover) the window 116 until removed. As described in more detail herein, the sidetrack casing assembly 114 may be introduced into the wellbore 106 along with the casing string 112 and advanced downhole until reaching a predetermined depth where a lateral or "secondary" wellbore 120 (shown in dashed lines) is to be drilled. Upon reaching the predetermined depth, the casing string 112 may be oriented in a predetermined orientation to align the window 116 with a predetermined path for the secondary wellbore 120 to extend from the primary wellbore 106. Once the casing string 112 is rotated to the predetermined orientation, the cover 118 may be disengaged (removed) to expose the window 116, which allows a drilling assembly to subsequently be run downhole and through the open window 116 to initiate creation of the secondary wellbore 120.

Figure 2A:
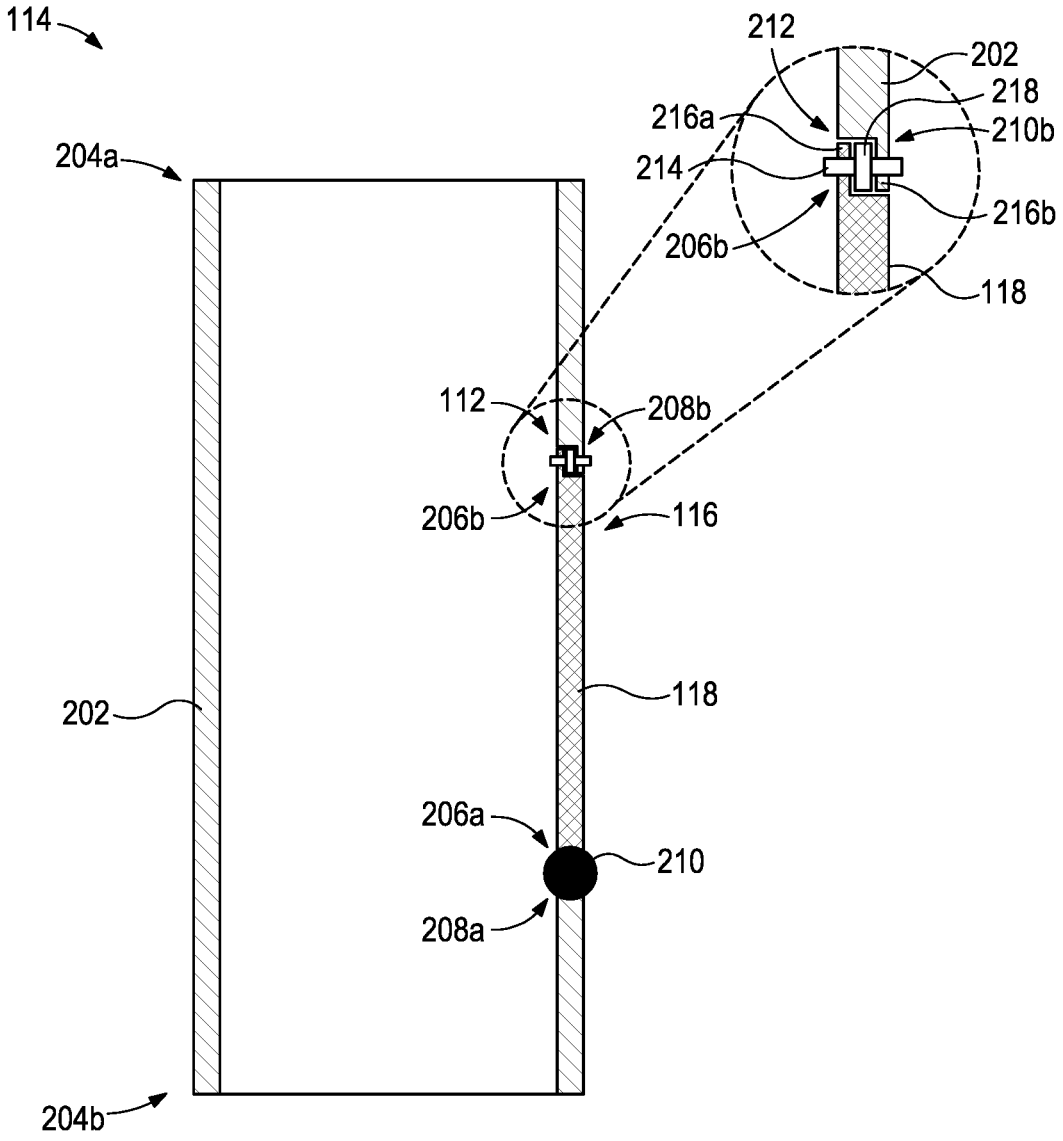
FIG. 2A is a schematic, cross-sectional side view of one example of the sidetrack casing assembly of FIG. 1, according to one or more embodiments of the present disclosure.

FIG. 2A is a schematic, cross-sectional side view of one example of the sidetrack casing assembly 114, according to one or more embodiments of the present disclosure. As illustrated, the sidetrack casing assembly 114 may include a cylindrical housing 202 having a first or "upper" end 204*a* and a second or "lower" end 204*b* opposite the upper end 204*a*. In some embodiments, the housing 202 may form an integral part of the casing string 112 (FIG. 1). In such embodiments, the housing 202 may comprise a length or section of casing, and the upper and lower ends 204*a,b* may provide box or pin connectors capable of coupling the housing 202 end-to-end with upper and lower casing sections, respectively. In other embodiments, however, the housing 202 may comprise a separate length of tubing or pipe configured to be inserted between upper and lower sections of the casing string 112 at the upper and lower ends 204*a,b*. In yet other embodiments, the upper end 204*a* of the sidetrack casing assembly 114 may be coupled to the distal end of the casing string 112, thus forming the distal portions of the casing string 112.

The sidetrack casing assembly 114 includes the window 116, alternately referred to as a "casing window," which may be defined through the sidewall of the housing 202. In some embodiments, the dimensions (e.g., height and arcuate or curved width) of the window 116 may be selected based on the diameter or width of the secondary wellbore 120 (FIG. 1) to be drilled (created) from the primary wellbore 106 (FIG. 1).

The sidetrack casing assembly 114 further includes the cover 118 sized to occlude the window 116. The cover 118 can exhibit a curved profile that matches the curvature of the housing 202, and the housing 202 generally matches the curvature of the casing string 112 (FIG. 1). The cover 118 may be transitioned between a first or "closed" state, in which the cover 118 is attached to the housing 202 and substantially or entirely occludes the window 116, and a second or "open" state, in which the cover 118 is moved or otherwise transitioned to expose (open) the window 116. The cover 118 can exhibit a profile and dimension based on the shape and dimension of the window 116, such that when the cover 118 is secured at the window 116 in the closed state, the cover 118 substantially or entirely seals the window 116 and the sidetrack casing assembly 114 is thereby capable of withstanding downhole forces and pressures during conveyance and installation in the primary wellbore 106 (FIG. 1).

The cover 118 may assume various designs capable of transitioning between the closed and open states. In the illustrated embodiment, for example, the cover 118 includes a first or "bottom" end 206*a* and a second or "top" end 206*b* opposite the bottom end 206*a*. The bottom end 206*a* may be pivotably coupled to the housing 202 at a bottom edge 208*a* of the window 116 using one or more hinges 210 (one shown), and the top end 206*b* may be removably (detachably) coupled to the housing 202 at a top edge 210*b* of the window 116 using one or more detachable couplings 212 (one shown). Since the cover 118 may exhibit a curved profile, the curved, bottom end 206*a* of the cover 118 can be hingedly coupled to the curved, bottom edge 208*a* of the window 116, and the curved, top end 206*b* of the cover 118 can be removably coupled to the curved, top edge 208*b* of the window 116, such that the housing 202 exhibits a cylindrical profile when the cover 118 is in the closed state. It will be appreciated, however, that the sidetrack casing assembly 114 can exhibit other shapes, without departing from the scope of the disclosure.

The inset graphic of FIG. 2A depicts an enlarged example of the detachable coupling 212, according to one or more embodiments. In the illustrated example, the detachable coupling 212 removably attaches the top end 206*b* of the cover 118 to the top edge 210*b* of the window 116 using one or more shearable devices 214 (one shown), such as a shear pin or the like. However, once the shearable device 214 is sheared and otherwise broken, the top end 206*b* of the cover 118 is able to disengage from the top edge 210*b* of the window 116 and the cover 118 is able to pivot (fall) to the interior of the housing 202. As described herein, the shearable device 214 may be sheared when a drilling assembly is introduced downhole to drill the secondary wellbore 120 (FIG. 1) and the drilling assembly contacts the shearable device.

In one or more alternative embodiments, however, the detachable coupling 212 may comprise a pressure-activated latch system configured to selectively detach the cover 118 from the housing 202 using fluid pressure (e.g., hydraulic or pneumatic). In such embodiments, the pressure-activated latch system can be activated from the rig 102 (FIG. 1) or from a downhole console. Moreover, in such embodiments, the pressure-activated latch system may be actuated manually or may be automated and based on obtained downhole sensor measurements. Once activated, the pressure-activated latch system operates to disengage the latches and decouples the cover 118 from the window 116, thereby opening/exposing the window 116 in the open state.

In some embodiments, the top end 206*b* of the cover 118 provides or defines an upward extension 216*a* and the top edge 210*b* of the window 116 provides or defines a downward extension 216*b* that laterally coincides with the upward extension 216*a* when the cover 118 is in the closed state. In the illustrated embodiment, the upward extension 216*a* is provided radially inward from the downward extension 220*b* when the cover 118 is in the closed state, which helps prevent the cover 118 from pivoting (falling) outward. However, once the shearable device 214 is sheared, the top end 206*b* of the cover 118 is able to pivot inward to the interior of the housing 202 and away from the top edge 210*b* of the window 116.

In one or more embodiments, the detachable coupling 212 may further include one or more sealing elements 218 (one shown) arranged at the interface between the top end 206*b* of the cover 118 and the top edge 210*b* of the window 116 and, more particularly, generally between the cover 118 and the window 116. Accordingly, the sealing element 218 may extend about the entire opening of the window 116 to provide a sealed interface between the window 116 and the cover 118, which allows a well operator to conduct various well control operations. In some applications, the sealing element 218 may also prove advantageous in urging the cover 118 to fall into the interior of the housing 202 upon disengagement from the top edge 210*b* of the window 116.

Figure 2C:
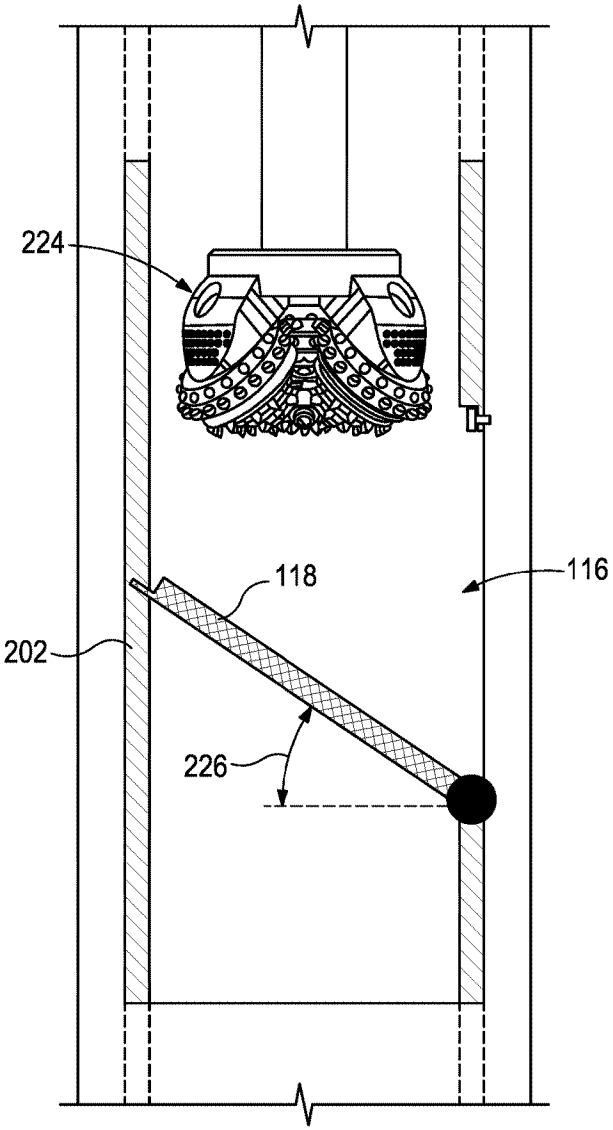
FIGS. 2B-2D depict progressive operation of the sidetrack casing assembly of FIG. 2A, according to one or more embodiments.
Figure 2B:
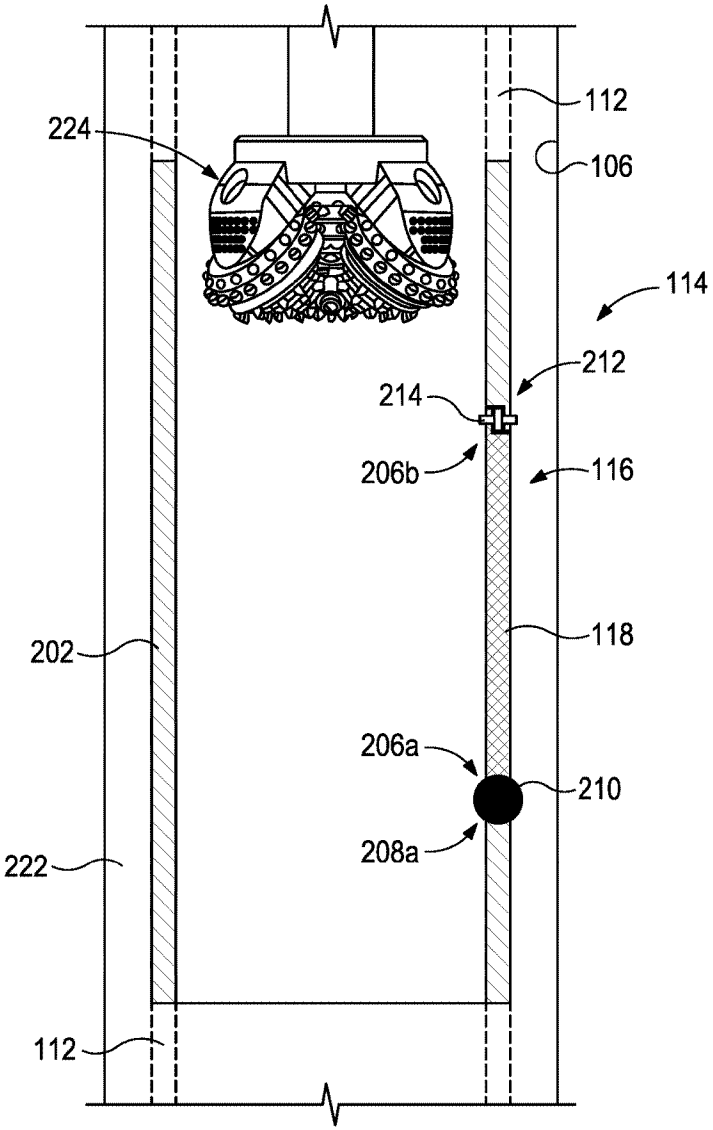
Figure 2D:
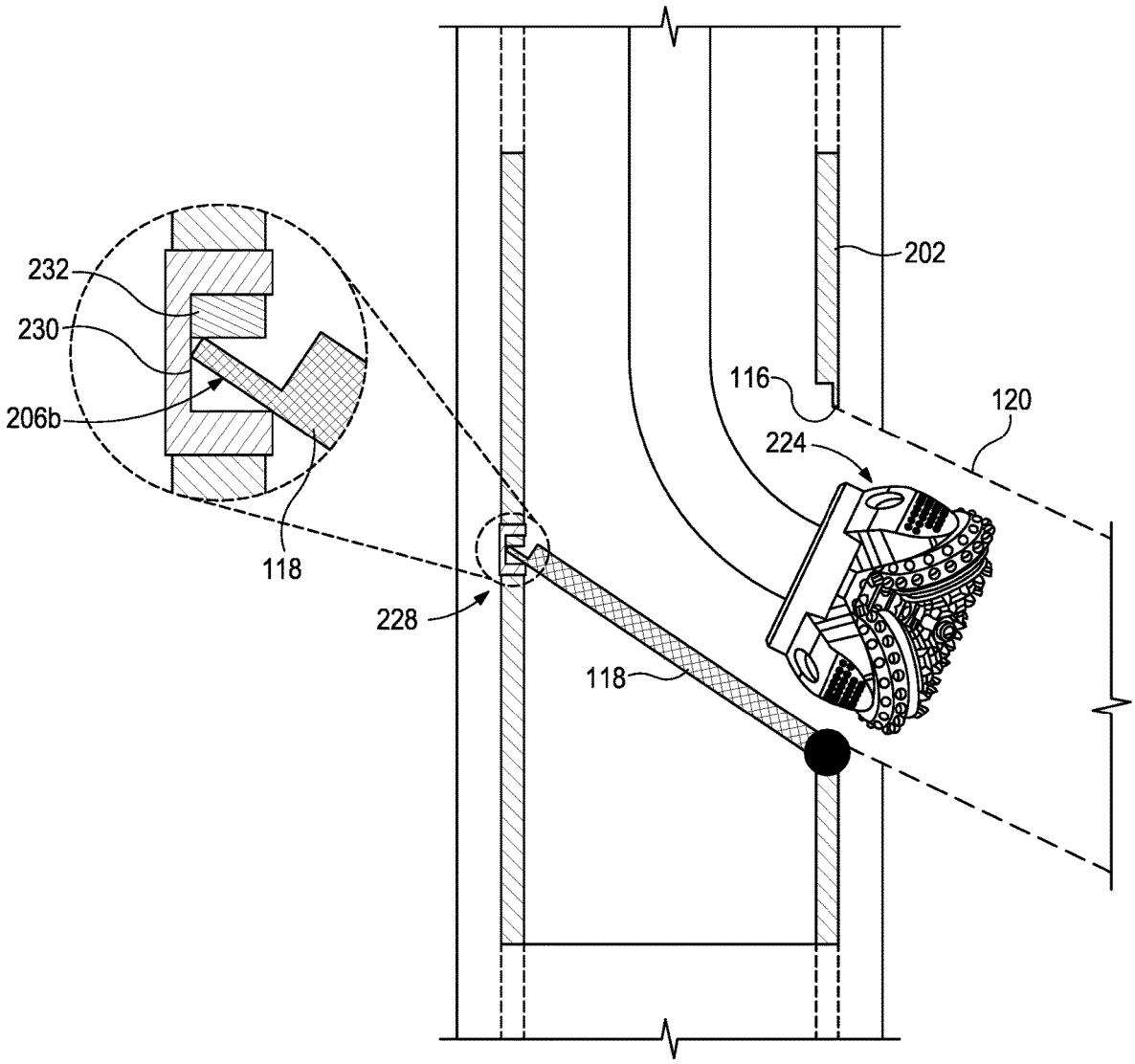

FIGS. 2B-2D depict progressive example operation of the sidetrack casing assembly 114, according to one or more embodiments. Referring first to FIG. 2B, before actuating or using the sidetrack casing assembly 114, the casing string 112 and sidetrack casing assembly 114 are introduced into the wellbore 106 and advanced to a predetermined depth within the wellbore 106. As described in more detail below, a gyroscope may be conveyed downhole on wireline and used to determine and confirm the proper angular orientation of the sidetrack casing assembly 114. More particularly, with the help of gyroscopic readings, the sidetrack casing assembly 114 will be oriented such that the window 116 and the cover 118 are aligned with a predetermined target wellbore path for the secondary wellbore 120 (FIG. 1). Once the proper orientation is achieved, a mechanical anchor (not shown) can be activated to secure the casing string 112 and the sidetrack casing assembly 114 in the wellbore 106, and the gyroscope can then be retrieved to surface.

In preparation for actuating (activating) the sidetrack casing assembly 114, cement can be pumped downhole to the bottom of the primary wellbore 106 and back up an annulus 222 defined between the casing string 112 and the inner wall of the wellbore 106. The cement may be pumped into the annulus 222 to a depth that reaches below the window 116.

Still referring to FIG. 2B, once the cement has been properly pumped downhole, a drilling assembly 224 is introduced into the primary wellbore 106 and advanced downhole to the sidetrack casing assembly 114. In some embodiments, as the drilling assembly 224 reaches the sidetrack casing assembly 114, a portion of the drilling assembly 224 (e.g., the drill bit) may engage and shear the shearable device 214 provided by the detachable coupling 212. Shearing the shearable device 214 effectively disengages the top end 206*b* (FIG. 2A) of the cover 118 from the window 116, thereby allowing the cover 118 to transition from the closed state to the open state. The bottom end 206*a* of the cover 118 remains pivotably coupled to the bottom edge 208*a* of the window 116 with the hinge(s) 210, thus allowing the cover 118 to pivot inward and into the interior of the housing 202 and rest against the opposing inner sidewall opposite to the window 116. As described below, the now-inclined cover 118 within the housing 202 can act as a whipstock that diverts and guides the drilling assembly 224 towards the now-open window 116 of the sidetrack casing assembly 114 and allows the drilling assembly 224 to further advance and create the sidetrack wellbore 120 (FIG. 1) through the window 116.

To verify that the cover 118 has fallen into the interior of the housing 202, the drilling assembly 224 may be pulled uphole a short distance after shearing the shearable device(s) 214, then advanced downhole to engage or "tag" the cover 118. If the drilling assembly 224 is unable to engage or "sense" the cover 118 within the interior of the housing 202, that may be an indication that the window 116 remains in the closed state. In such scenarios, the window 116 may be forced to the open state by injecting a small amount of fluid pressure into the annulus 222 from the surface (e.g., the rig 102 of FIG. 1). The increased fluid pressure will act on the cover 118 from the annulus 222 and help force it to the open state.

In FIG. 2C, the cover 118 has transitioned to the open state, and rests on the inner wall of the housing 202 in an inclined position. Transitioning the cover 118 to the open state opens or exposes the window 116, and the now-inclined cover 118 can act as a whipstock capable of redirecting and guiding the drilling assembly 224 into the now-open window 116 of the sidetrack casing assembly 114. Further downhole advancement of the drilling assembly 224 upon passing through the window 116 will initiate drilling (creation) of the sidetrack wellbore 120 (FIG. 1) through the window 116. The dimension (or length) of the cover 118 can be selected such that the disengaged cover 118 becomes inclined at a predefined acute angle 226 from the sidewall in the interior of the housing 202. The predefined acute angle 226 can be selected based on a predetermined angle at which the secondary wellbore 120 is to be created and extended from the primary wellbore 106.

In FIG. 2D, the drilling assembly 224 has been advanced downhole and at least partially through the window 116 to initiate drilling (creation) of the sidetrack wellbore 120. The inclined cover 118 acts as a make-shift whipstock to redirect the drilling assembly 224 through the window 116.

In some embodiments, the sidetrack casing assembly 114 may further include a latch mechanism 228 provided at a predetermined position on the sidewall within the housing 202 opposite the window 116. The latch mechanism 228 may be configured to receive and secure the top end 206*b* of the cover 118 upon moving to the open state. The position of the latch mechanism 228 can be selected based on the length of the cover 118 and the position of the window 116 on the housing 202, such that the top end 206*b* of the cover 118 is able to fall and latch/lock at the latch mechanism 228 of the sidetrack casing assembly 114.

As depicted in the enlarged inset graphic of FIG. 2D, the latch mechanism 228 can be arranged within a pocket 230 defined in the inner wall of the housing 202. The pocket 230 may be large enough to receive the top end 206*b* of the cover 118. Moreover, the latch mechanism 228 includes a latch 232 arranged within the pocket 230 and configured to allow the top end 206*b* of the cover 118 to enter the pocket 230, and subsequently prevent the top end 206*b* from escaping the pocket 230 once received therein. The latch 232 may prove advantageous in preventing accidental closing of the window 116.

Figure 3A:
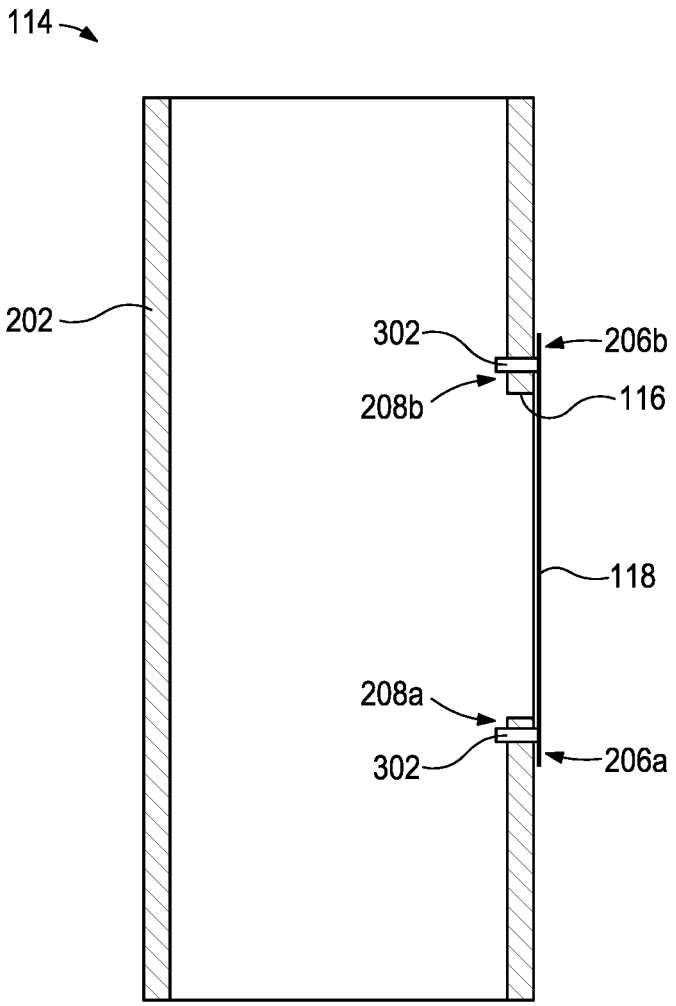
FIG. 3A is cross-sectional front view of another example of the sidetrack casing assembly of FIG. 1, according to one or more additional embodiments.

FIG. 3A is cross-sectional front view of another example of the sidetrack casing assembly 114, according to one or more additional embodiments. The sidetrack casing assembly 114 shown in FIG. 3A is similar in some respects to the sidetrack casing assembly 114 of FIG. 2A, and may therefore be best understood with reference thereto, where like numerals will correspond to like components not described again in detail. As illustrated, the sidetrack casing assembly 114 includes the housing 202 that defines the window 116 already created on the sidewall of the housing 202. The sidetrack casing assembly 114 further includes the cover 118 removably attached to the housing 202 to occlude the window 116.

In the illustrated embodiment, the cover 118 is attached to the exterior surface (outer circumference) of the housing 202. The area/size of the cover 118 may preferably be greater than the size of the window 116 such that the cover 118 can completely occlude and seal the window 116. Moreover, the cover 118 may be larger than the window 116 so that the cover 118 does not inadvertently fall into the interior of the housing 202 in the closed state.

In the illustrated embodiment, the top and bottom ends 206*a,b* of the cover 118 are removably (detachably) coupled to the housing 202 at or near the top and bottom edges 208*a,b* of the window 116 using one or more shearable devices 302. Similar to the shearable devices 214 of FIGS. 2A-2D, the shearable devices 302 may secure the cover 118 in the closed state until sheared or broken, at which point the cover 118 can transition to the open state. As described herein, the shearable devices 302 may be sheared when a whipstock assembly and/or a drilling assembly is introduced downhole to drill the secondary wellbore 120 (FIG. 1) and the whipstock assembly and/or the drilling assembly contacts the shearable devices 302. Upon shearing the shearable devices 302, the cover 118 can disengage from the housing 202 and fall into the annulus 222 (FIG. 3B) between the sidetrack casing assembly 114 and the wellbore wall, thereby opening/exposing the window 116.

In one or more alternative embodiments, the shearable devices 302 may be omitted and the cover 118 may be removably attached to the housing 202 using a pressure-activated latch system configured to detach the cover 118 from the housing 202 using fluid pressure (e.g., hydraulic or pneumatic). In such embodiments, the pressure-activated latch system can be activated from the rig 102 (FIG. 1) or from a downhole console. Moreover, in such embodiments, the pressure-activated latch system may be actuated manually or may be automated and based on obtained downhole sensor measurements. Once activated, the pressure-activated latch system operates to disengage the latches and decouples the cover 118 from the window 116, thereby opening/exposing the window 116 in the open state.

Figure 3C:
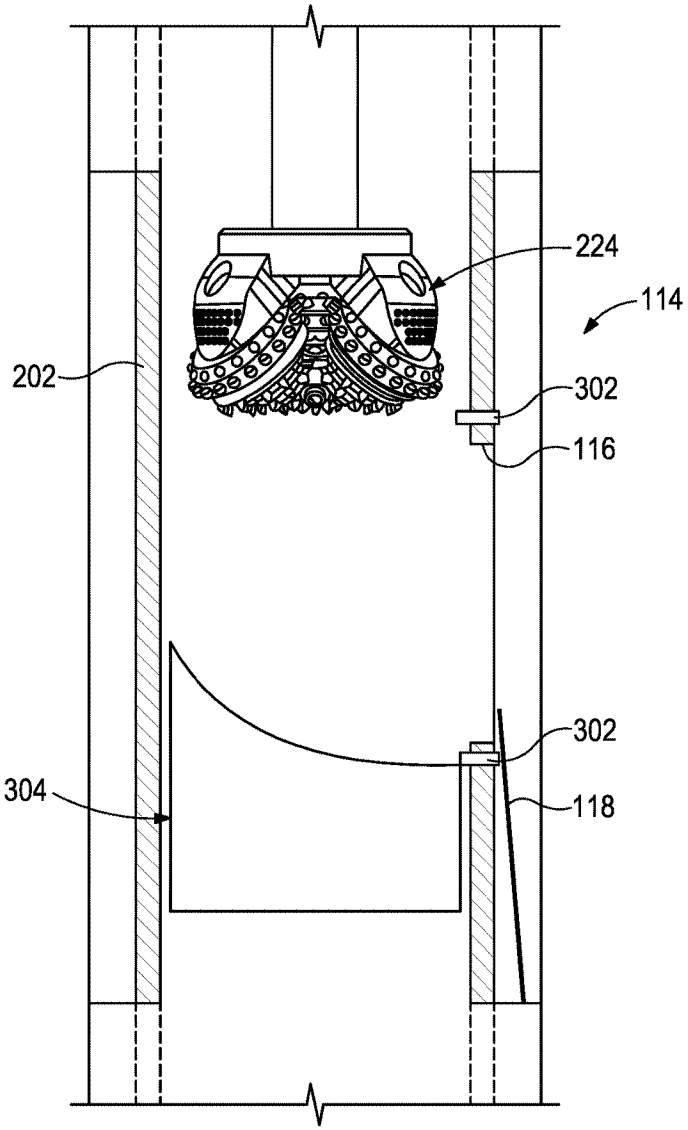
FIGS. 3B-3D depict progressive operation of the sidetrack casing assembly of FIG. 3A, according to one or more embodiments.
Figure 3B:
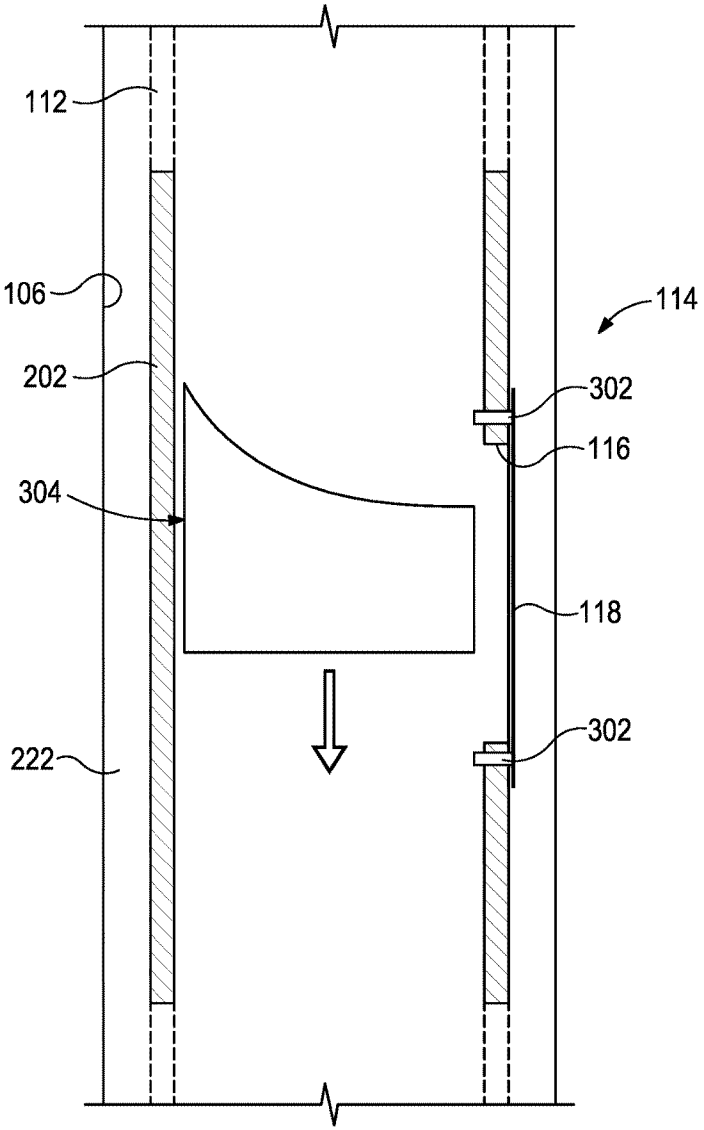
Figure 3D:
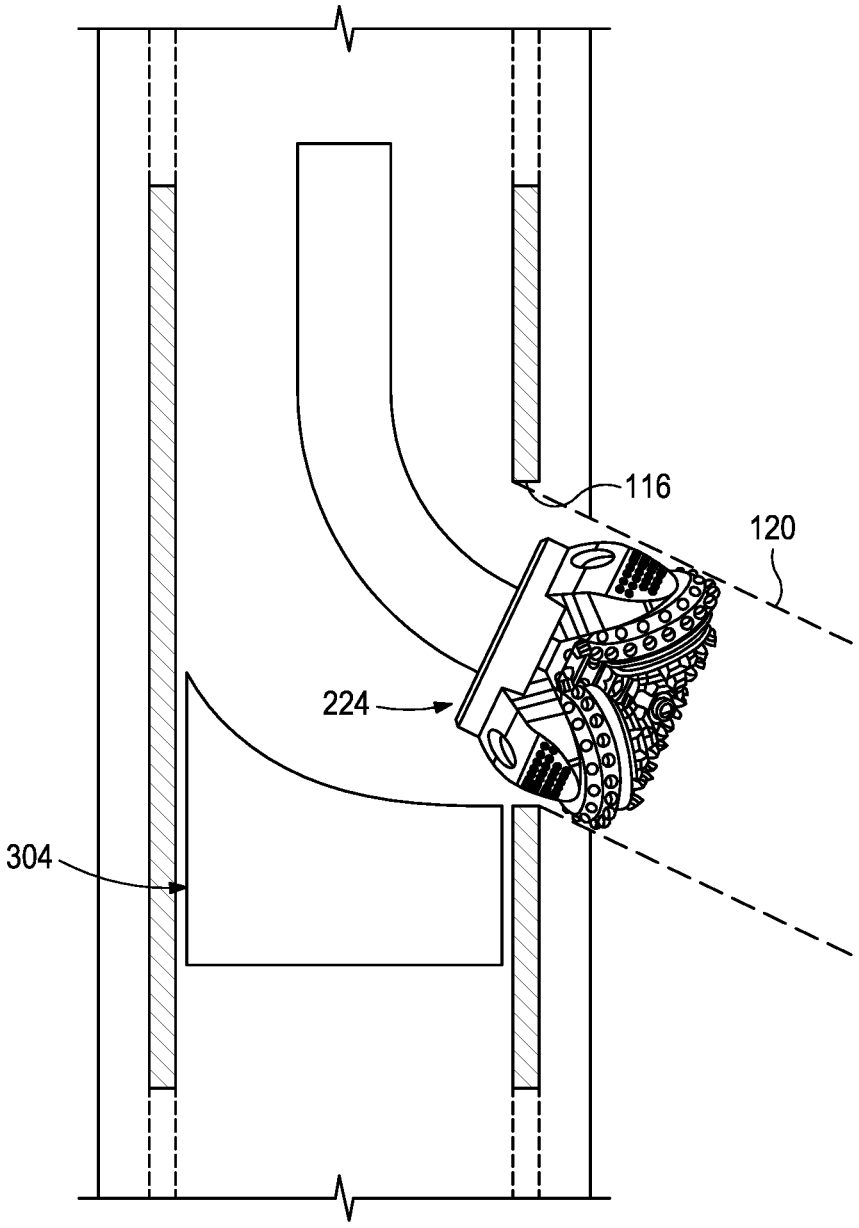

FIGS. 3B-3D depict progressive example operation of the sidetrack casing assembly 114 of FIG. 3A, according to one or more embodiments. Referring first to FIG. 3B, the sidetrack casing assembly 114 is run into the wellbore 106 on the casing string 112 to a predetermined depth, following which the sidetrack casing assembly 114 is angularly oriented to the proper angular direction for drilling the sidetrack wellbore 120 (FIG. 1) using a gyroscope, as briefly mentioned above and as discussed in more detail below. Once the sidetrack casing assembly 114 is properly oriented and secured within the wellbore 106, cement is then pumped downhole to the bottom of the primary wellbore 106 and back up the annulus 222 between the sidetrack casing assembly 114 and the inner wall of the wellbore 106. The cement may be pumped such that the top of the cement within the annulus 222 remains below the window 116.

Once the cement is properly introduced downhole, a whipstock assembly 304 may be introduced downhole and secured within the wellbore 106 at the sidetrack casing assembly 114 and, more particularly, at or just below the window 116. In some embodiments, advancing the whipstock assembly 304 downhole simultaneously engages and shears the shearable devices 302, which causes (or allows) the cover 118 to detach from the housing 202 and fall into the annulus 222, thereby opening/exposing the window 116.

In FIG. 3C, the whipstock assembly 304 is shown secured within the wellbore (e.g., within the sidetrack casing assembly 114) below the window 116, and the cover 118 has been detached from the housing 202. Moreover, the drilling assembly 224 is shown being advanced into the wellbore 106 and to the sidetrack casing assembly 114 to be redirected into the now-open window 116 with the whipstock assembly 304. In some embodiments, the whipstock assembly 304 and the drilling assembly 224 may be introduced simultaneously downhole. In such embodiments, the whipstock assembly 304 will be positioned at a predetermined distance below the drilling assembly 224. Moreover, in such embodiments, one or both of the whipstock assembly 304 and the drilling assembly 224 may be configured to shear the shearable devices 302. In at least one embodiment, for example, the whipstock assembly 304 may be configured to engage and shear the lower shearable device 302, and the drilling assembly 224 may be configured to engage and shear the upper shearable device 302. In yet other embodiments, the sidetrack casing assembly 114 may be designed such that the drilling assembly 224 is able to shear all the shearable devices 302, without departing from the scope of the disclosure.

If the cover 118 does not disengage from the window 116 upon shearing the shearable devices 302, a small amount of fluid pressure can be applied to the cover 118 from within the inside of the sidetrack casing assembly 114. This fluid pressure may help urge the cover 118 to detach from the housing 202 and fall into the annulus 222.

In FIG. 3D, the drilling assembly 224 is shown being advanced further downhole and through the window 116 to initiate drilling (creation) of the sidetrack wellbore 120. The whipstock assembly 304 provides a curved or inclined ramp that operates to divert and guide the drilling assembly 224 through the opened window 116 where the drilling assembly 224 can be further advanced to create the sidetrack wellbore 120.

Figure 4:
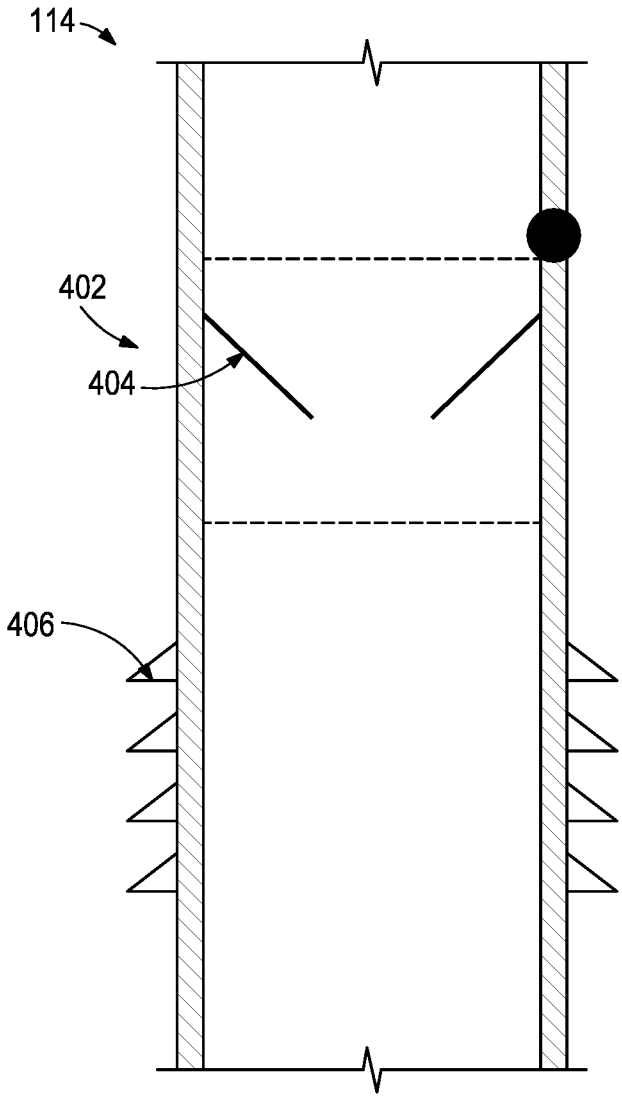
FIG. 4 is a cross-sectional side view of an example orientation sub that may be used to angularly orient the sidetrack casing assembly of FIG. 1, according to one or more embodiments of the present disclosure.

FIG. 4 is a cross-sectional side view of an example orientation sub 402 that may be used to angularly orient the sidetrack casing assembly 114, according to one or more embodiments of the present disclosure. In some embodiments, as illustrated, the orientation sub 402 may be operatively coupled to the sidetrack casing assembly 114 and located below or distal to the sidetrack casing assembly 114. The orientation sub 402 may be operable to help ensure proper angular alignment of the sidetrack casing assembly 114 with the proposed path for the sidetrack (lateral) wellbore 120 (FIG. 1) to be subsequently drilled. The orientation sub 402 includes a profile 404 configured to receive a gyroscope (not shown) on wireline and allow the gyroscope to set and take orientation readings of the sidetrack casing assembly 114. Accordingly, the orientation of the sidetrack casing assembly 114 can be adjusted based on gyroscope readings and the gyroscope can subsequently be retrieved to surface.

After confirming the orientation of the sidetrack casing assembly 114 to be correct, the sidetrack casing assembly 114 can be secured within the wellbore in the predetermined orientation by setting a mechanical anchor or "anchor joint" 406. The mechanical anchor 406 helps secure the sidetrack casing assembly 114 at the required depth and the predetermined orientation within the primary wellbore 106 (FIG. 1). In some embodiments, the mechanical anchor 406 can be set by giving the casing string 112 (FIG. 1) slack from the rig 102 (FIG. 1), which places a downward load on the orientation sub 402 and thereby activates the mechanical anchor 406.

Thus, the present invention is believed to save the time, cost, and effort to create a sidetrack (or lateral) wellbore by modifying the casing to have an opening to the side track (lateral). In addition, the sidetrack casing technique of the present invention is simpler than the existing techniques since there is no requirement for different drilling BHA and multiple runs to create the sidetrack wellbore. Further, as the cover disengages from the top end of the window and rests on the inner wall of the casing in an inclined manner, the wall of the inclined cover acts as a whipstock assembly, which eliminates the requirement of any additional whipstock assembly as compulsorily required in existing techniques, thereby saving time, cost, and effort to create the sidetrack wellbore The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and are not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a casing string extendable into a primary wellbore from a surface rig; and a sidetrack casing assembly coupled to the casing string and including:

a cylindrical housing that defines a window through a sidewall of the housing;

a cover removably coupled to the housing at the window; and a latch mechanism provided on the sidewall within the housing opposite the window, wherein the cover is transitionable between a closed state, in which the cover is attached to the housing and occludes the window, and an open state, in which the cover is moved to expose the window for drilling a secondary wellbore from the primary wellbore, and wherein the latch mechanism is configured to receive and secure a portion of the cover upon moving to the open state.

2. The well system of claim 1, wherein a bottom end of the cover is pivotably coupled to a bottom edge of the window, and a top end of the cover is detachably coupled to a top edge of the window.

3. The well system of claim 2, wherein the cover transitions to the open state by detaching from the top edge of the window and pivoting into the interior of the housing at the bottom edge of the window.

4. The well system of claim 2, wherein the top end of the cover is detachably coupled to the top edge of the window with a detachable coupling that includes one or more shearable devices.

5. The well system of claim 4, wherein the one or more shearable devices are sheared by a drilling assembly advancing within the casing string to the sidetrack casing assembly.

6. The well system of claim 4, wherein the detachable coupling further includes one or more sealing elements arranged at an interface between the top end of the cover and the top edge of the window.

7. The well system of claim 2, wherein the latch mechanism is configured to receive and secure the top end of the cover upon moving to the open state.

8. The well system of claim 1, further comprising an example orientation sub operatively coupled to the sidetrack casing assembly and located distal to the sidetrack casing assembly, the orientation sub including a mechanical anchor that is activated to secure the sidetrack casing assembly at a required depth and a predetermined angular orientation within the primary wellbore.

9. A method for creating a secondary wellbore from a primary wellbore, comprising:

conveying a casing string into the primary wellbore from a surface rig, wherein a sidetrack casing assembly is coupled to the casing string and includes:

a cylindrical housing that defines a window through a sidewall of the housing;

a cover removably coupled to the housing at the window; and a latch mechanism provided on the sidewall within the housing opposite the window;

anchoring the casing string within the primary wellbore at a predetermined depth and a predetermined angular orientation where the window aligns with a proposed wellbore path for the secondary wellbore;

transitioning the cover from a closed state, in which the cover is attached to the housing and occludes the window, to an open state, in which the cover is moved to expose the window, wherein the latch mechanism is configured to receive and secure a portion of the cover upon moving to the open state;

advancing a drilling assembly into the casing and through the window; and drilling the secondary wellbore with the drilling assembly.

10. The method of claim 9, wherein a bottom end of the cover is pivotably coupled to a bottom edge of the window, and a top end of the cover is detachably coupled to a top edge of the window, and wherein transitioning the cover from the closed state to the open state comprises:

detaching the cover from the top edge of the window; and pivoting the cover into the interior of the housing at the bottom edge of the window.

11. The method of claim 10, wherein advancing the drilling assembly into the casing and through the window comprises:

engaging the drilling assembly on the cover; and diverting the drilling assembly into the window with the cover.

12. The method of claim 10, wherein pivoting the cover into the interior of the housing further comprises:

receiving the top end of the cover at the latch mechanism; and securing the cover in the open position with the latch mechanism.

* * * * *